US005542536A

United States Patent [19]

Sutherland

[11] Patent Number: 5,542,536

[45] Date of Patent: Aug. 6, 1996

[54] WRAP-AROUND CARRIER WITH BAR CODE BLOCKING END PANEL

[75] Inventor: Robert L. Sutherland, Kennesaw, Ga.

[73] Assignee: Riverwood International Corporation, Atlanta, Ga.

[21] Appl. No.: 439,465

[22] Filed: May 11, 1995

[51] Int. Cl.[6] ..... B65D 71/12

[52] U.S. Cl. ..... 206/427; 206/140; 206/434

[58] Field of Search ..... 206/139–141, 206/145–147, 149–151, 152, 153, 158, 160, 161, 427, 428, 434, 435

[56] References Cited

U.S. PATENT DOCUMENTS

| | | | |
|---|---|---|---|
| 3,767,042 | 10/1973 | Ganz | 206/434 |
| 4,394,903 | 7/1983 | Bakx | 206/427 |
| 4,440,340 | 4/1984 | Bakx | 206/434 |
| 5,000,313 | 3/1991 | Oliff | 206/434 |
| 5,060,792 | 10/1991 | Oliff | 206/434 |
| 5,180,054 | 1/1993 | Bakx | 206/434 |
| 5,311,984 | 5/1994 | Harris | 206/434 |

FOREIGN PATENT DOCUMENTS

| | | | |
|---|---|---|---|
| 94/26619 | 11/1994 | WIPO | 429/429 |

*Primary Examiner*—Jimmy G. Foster

[57] ABSTRACT

A wrap-around carrier including partial end panels extending up from the bottom panel for covering the pricing code on the end articles in the package. The partial end panels are locked in place by gusset panels extending between an adjacent end article and the bottom panel and by side panel locking flaps extending between an adjacent end article and a connected side panel. Upper and lower corner restraint panels are also connected to the side panel locking flaps.

13 Claims, 4 Drawing Sheets

WRAP-AROUND CARRIER WITH BAR CODE BLOCKING END PANEL

FIELD OF THE INVENTION

This invention relates to wrap-around article carriers. More particularly, it relates to wrap-around carriers which include partial end panels capable of blocking the pricing code printed on the end articles in the carrier.

BACKGROUND OF THE INVENTION

Certain types of articles, such as food or beverage containers, are commonly sold either as individual units or in a multi-container carton. Each article is normally marked with a bar pricing code to enable it to be scanned and automatically totaled at a retail outlet when sold as an individual item. When packaged in conventional open-ended wrap-around carriers, pricing errors can occur if the scanner sees the pricing code on one of the articles instead of the code on the package itself. One way to prevent this from happening is to package the articles in a completely enclosed carton or carrier. An enclosed carrier is quite expensive, however, compared to a wrap-around carrier due to the greater amount of stock required.

It is preferred to provide wrap-around carriers with partial end panels of a size sufficient to cover the pricing code on the end articles in the package. Such a design requires less stock than a fully enclosed carrier and is correspondingly more economical to produce. Partial end panels designed to cover pricing codes located near the bottom of the article require only a short panel extending up from the bottom panel. Ideally, the short end panels should be large enough to cover the pricing code of the end articles, should not interfere with the normal fabrication and packaging methods of wrap-around carriers and should be locked in place after being formed. Preferably, the end panel arrangement should not only be locked in place but should also positively resist any tendency of the end articles to fall out of the package.

The main object of the invention, therefore, is to provide a wrap-around carrier with an improved partial end panel design which covers the pricing code of end articles and also prevents outward movement of the articles.

BRIEF SUMMARY OF THE INVENTION

The invention is embodied in a package formed of a carrier of basic wrap-around design containing two rows of adjacent articles. The bottom panel flaps of the carrier are connected to partial end panel flaps which are also connected to lower corner restraint panels. In addition, first and second locking means are provided for locking the end panel flaps in place. The first locking means is connected to the bottom panel flaps and the second locking means is connected to the side panels. Each of the first and second locking means engages an adjacent end article in the package.

In a preferred arrangement the first locking means comprises a gusset panel connected by fold lines to each end panel flap and to the associated bottom panel flap, with each gusset panel having an intermediate fold line extending between the adjacent end article and the associated bottom panel flap. The weight of the article maintains the gusset panels in their folded condition, thereby resisting outward movement of the end panel flaps. The second locking means in the preferred arrangement comprises a side panel locking flap foldably connected to each end of the side panels and to each lower corner restraint panel. The side panel locking flaps extend between, and are in contact with, the adjacent end article and the associated side panel, thereby locking the lower restraint panels and their connected end panel flaps in place. Upper corner restraint panels may also be provided by foldably connecting them to each side panel locking flap and to the top panel.

The features of the invention can be incorporated in carriers adapted to package various types of articles, including beverage cans and bottles. Not only do the partial end panels prevent price scanning of the bar code on lower portions of packaged articles, but they also function to securely hold the articles in place.

The significant features of the invention are brought out in more detail below in connection with the preferred embodiments, wherein the above and other aspects of the invention, as well as other benefits, will readily become apparent.

DETAILED DESCRIPTION OF THE PREFERRED EMBODIMENTS

Figure 1:
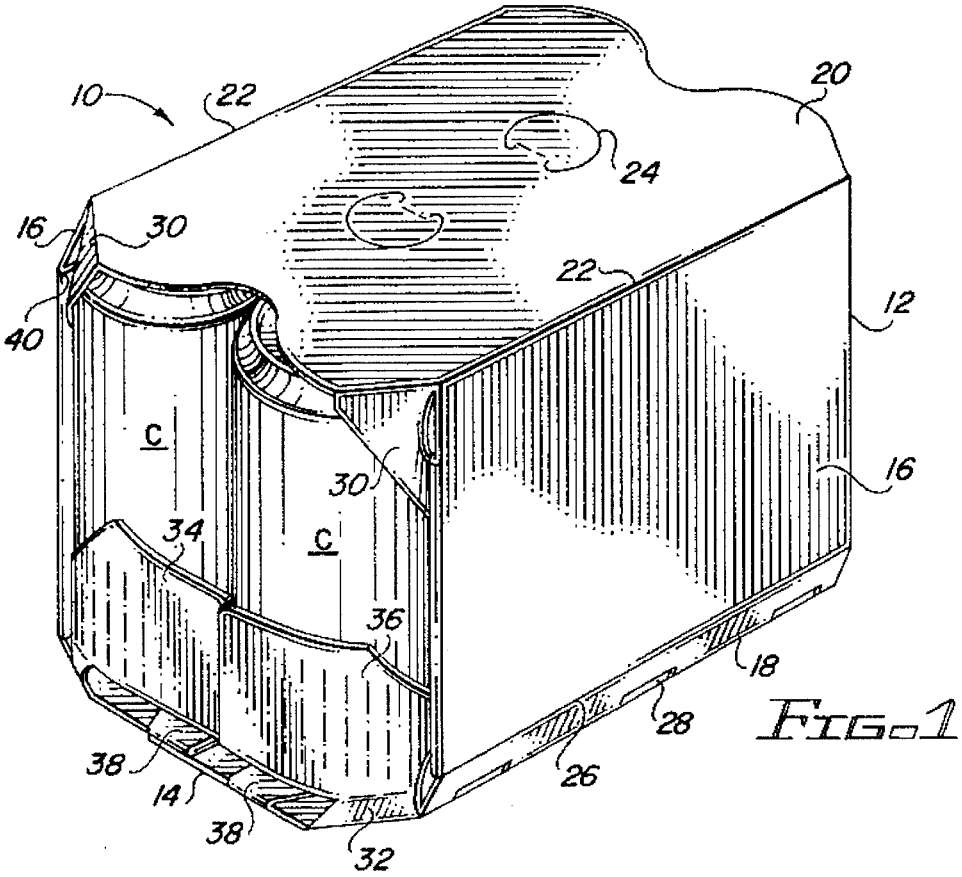
FIG. 1 is a pictorial view of the wrap-around carrier of the invention illustrated as part of a package containing six beverage cans.
Figure 2:
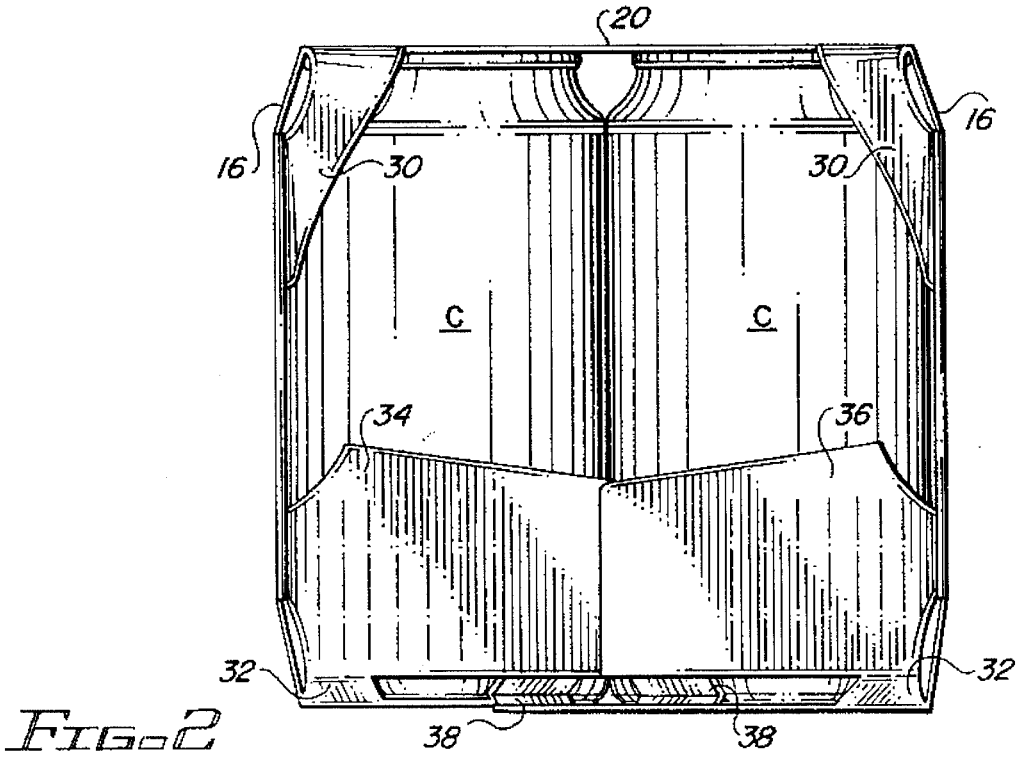
FIG. 2 is an end view of the carrier of FIG. 1.

Referring to FIGS. 1 and 2, a package 10 is comprised of a wrap-around carrier 12 containing six abutting beverage cans C, arranged in two rows of three cans each, supported on bottom panel 14. Side panels 16 are connected to the bottom panel 14 along fold lines 18 and to top panel 20 along fold lines 22. The top panel includes finger holes 24 to facilitate lifting the carrier. In addition, the lower portion of the side panels includes score line 26 and cutouts 28 to better permit the carrier wrapper to be pulled tightly about the cans. The carrier also includes upper and lower corner gusset restraints 30 and 32, respectively, which contact and resist outward movement of adjacent cans. Integral with the lower corner gusset restraints 32 are overlapping end panel flaps 34 and 36 which are also connected to the bottom panel by locking gusset panels or tabs 38. The purpose of the locking gusset panels 38 is explained in detail below. The upper and lower corner gusset restraints 30 and 32 are connected at one end to the top and bottom panels, respectively, and at the other end to side panel locking flaps 40. As explained in more detail below, the side panel locking flaps and the lower corner gusset restraints cause the end panel flaps to be folded into place.

Figure 3:
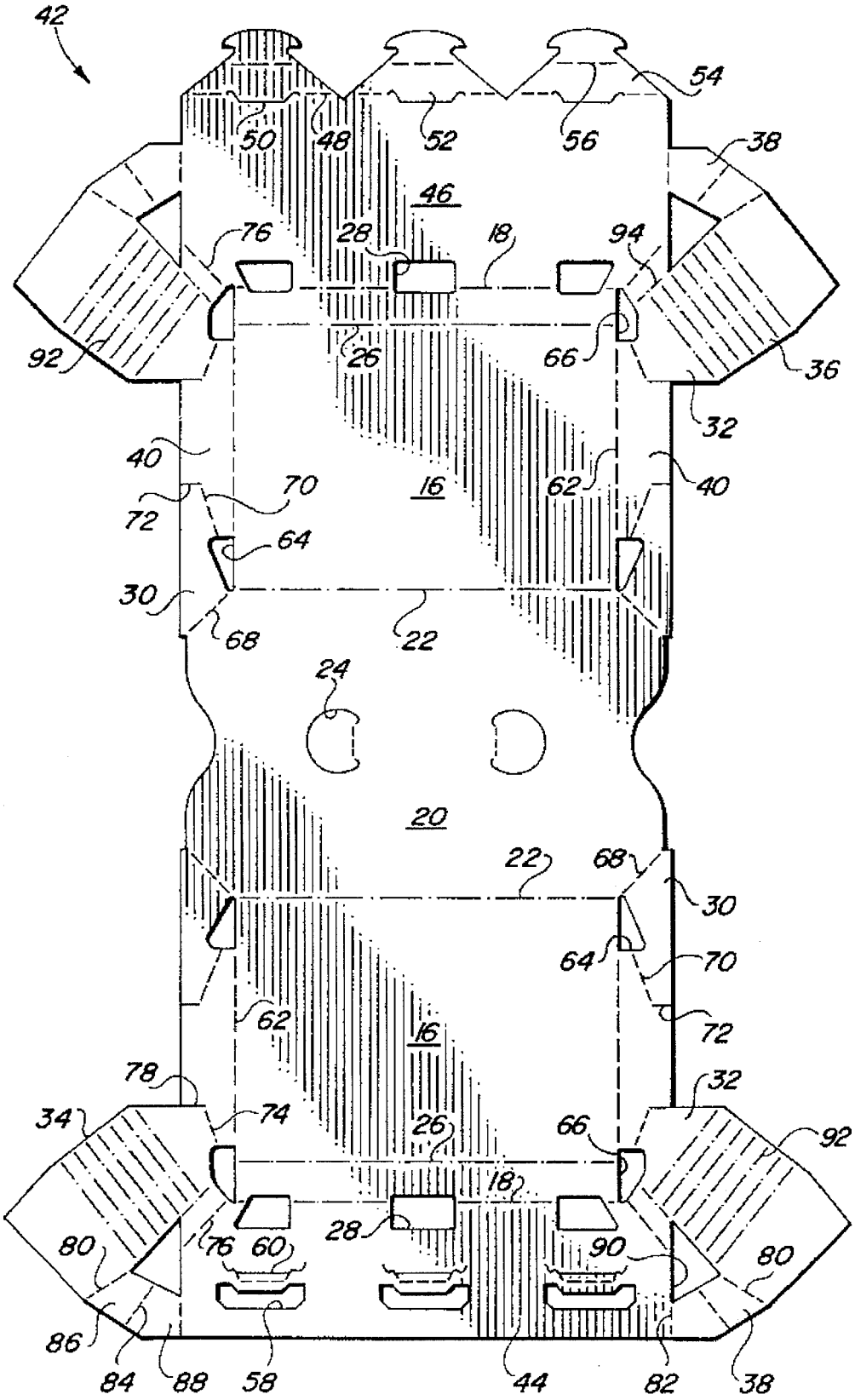
FIG. 3 is a plan view of a blank for forming the carrier of FIG. 1.

Referring to FIG. 3, wherein like reference numerals to those used in FIGS. 1 and 2 denote like elements, a blank 42 capable of being fabricated into the carrier of FIG. 1 includes a centrally located top panel section 20 connected to adjacent side panel sections 16 by the fold lines 22. One of the side panel sections 16 is connected by fold line 18 to bottom panel flap 44 and the other side panel section is connected by fold line 18 to bottom panel flap 46. The bottom panel flap 46, which partially overlaps the bottom panel flap 44 in a carrier formed from the blank and is referred to as the outer bottom panel flap, includes a fold line 48 which is interrupted by slits 50 forming primary male locking tabs 52. Secondary male locking tabs 54 are connected along fold line 48 and include an intermediate fold line 56. The bottom panel flap 44, which is the inner bottom panel flap, incorporates cutouts including primary female locking edges 58 adapted to engage the primary male locking tabs 52. The flap 44 also includes slits 60 adapted to receive the outer portions of the secondary locking tabs 54. Although these various locking elements are illustrated to demonstrate a typical bottom panel locking arrangement suitable for use with the carrier of the invention, it should be understood that any desired effective form of bottom panel locking means may be employed.

Still referring to FIG. 3, the side panel locking flaps 40 are connected to the side panel sections 16 by fold lines 62, which terminate at upper and lower cutouts 64 and 66, respectively. The upper gusset restraints 30 are connected along angled fold lines 68 to the corner areas of top panel section 20 and along angled fold lines 70 to associated side panel locking flaps 40. Each fold line 70 extends from a cutout 64 to a short slit 72, which in turn extends out to the edge of the locking flap 40 along a path substantially parallel to the fold lines 22. The lower gusset restraints 32, which as stated above are integrally formed with and are thus a part of the end panel flaps, are connected to associated side panel locking flaps 40 along angled fold lines 74 and to the bottom panel flaps along angled fold lines 76. Each fold line 74 extends from a cutout 66 to a short slit 78, which in turn is a continuation of an outer edge of the lower gusset restraints 32.

The end portions of the panel flaps 34 and 36 opposite the lower gusset restraints 32 are connected to the bottom panel flaps 44 and 46, respectively, by the locking gusset panels 38. The gusset panels 38 are connected to the end panel flaps by fold lines 80 and to the bottom panel flaps by fold lines 82. An additional fold line 84 extends transversely across the gusset panels 54 to form gusset panel tabs 86 and 88. A cutout 90 is provided in the bottom panel area, formed by the end edge of the bottom panel, an edge of the locking gusset panel 38 and an edge of the associated end panel flap 36 or 38.

Each end panel flap is provided with a series of rib score lines 92 and an angle score line 94, extending between cutouts 66 and 90. The rib score lines extend substantially vertically and the angle score lines extend substantially horizontally in a carrier formed from the blank.

Figure 4:
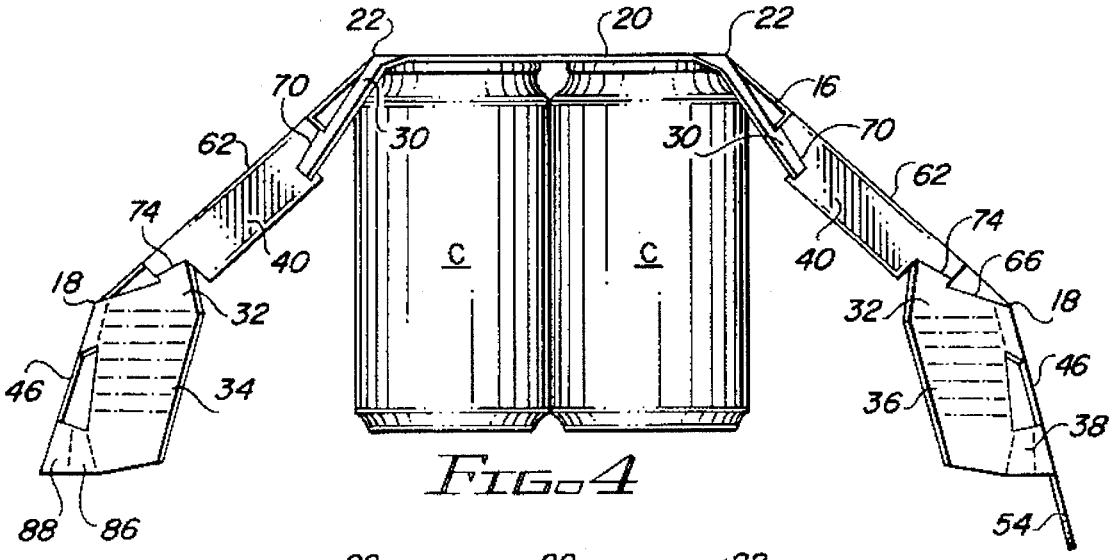
FIG. 4 is an end view of an initial stage of the carrier blank as it is being wrapped around a group of cans during formation of a carrier.

To form the package of FIG. 1, the blank of FIG. 3 is placed on top of a group of six cans and the side panel sections 16 are folded down about the fold lines 22. The bottom panel flaps 44 and 46 are then folded in along their fold lines 18 while at the same time pivoting the side panel locking flaps 40 in about the fold lines 62. Inward movement of the side panel locking flaps moves the fold lines 70 and 74 inwardly, which pulls the upper and lower gusset restraint panels 30 and 32 inwardly. This action folds the upper restraint panels 30 down about the fold lines 68 and the lower restraint panels 32 up about the fold lines 76. FIG. 4 illustrates the carrier at a representative point during this initial stage of fabrication.

Figure 5:
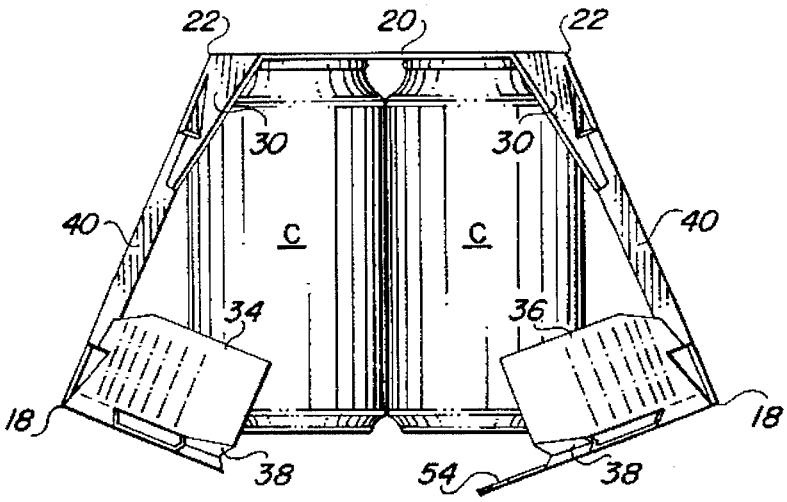
FIG. 5 is an end view similar to that of FIG. 4, but showing the carrier in a later stage of formation.

As the bottom panel flaps are folded about the fold lines 18, various movements of the elements of the blank take place. The side panel locking flaps 40 move toward their final position in which they lie substantially flat against the connected side panel, while movement of the lower gusset restraint panels 32 causes the end panel flaps 34 and 36 to pivot to a position substantially at right angles to the connected bottom panel flap. In addition, the gusset panel segments 86 and 88 are folded in about fold line 84 and held in place while the ends of the bottom panel flaps are moved toward each other into bottom panel locking position. The configuration of the blank in FIG. 5 illustrates the blank just prior to the bottom panel flaps reaching their final overlapping position. At this point the upper gusset restraint panels 30 have been formed to fit around adjacent outer upper portions of the cans when in their final position. The outer portions of the side panel locking flaps 40 which extend beyond the ends of the fold lines 70 and 74 are located so as to be pinched between the adjacent can and the adjacent side panel, thereby locking the side panel locking flaps in place.

Referring also to FIG. 3, when the gusset panel segments 88 are folded about fold lines 82 and 84, it brings the segments 88 into face-to-face contact with the bottom panel flaps 34 and 36. This causes the gusset panel segments 86 to move also, folding down about the intermediate fold line 84. The fold line 80, connecting the gusset panel segments 86 and the end panel flaps 34 and 36, moves with the segments 86, causing the end panel flaps to pivot up about the fold line 80. As this occurs, the end panel flap sections are pulled in toward the interior of the package to tightly contact the end articles in the package. The vertical score lines 92 permit the end panel flaps to follow the contour of adjacent cans, while the horizontal score lines 80 permit the flaps to generally follow the contour of the inwardly tapered lower portions of the cans.

Figure 6:
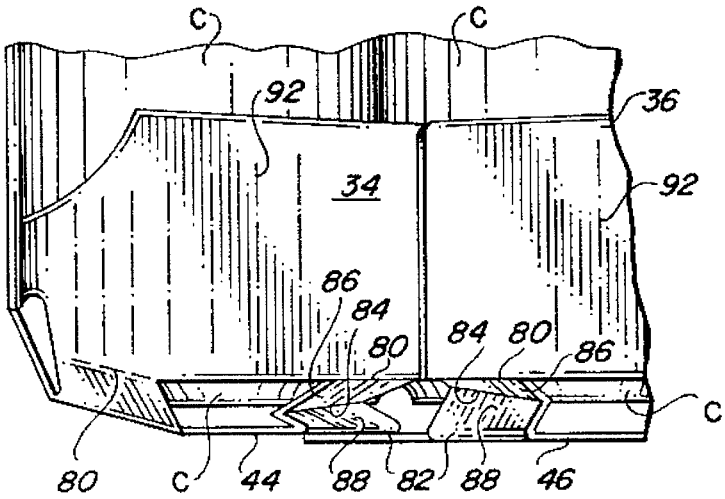
FIG. 6 is an enlarged partial pictorial view of the carrier, showing the relationship of locking gusset panels to the packaged cans.

When the bottom panel flaps are folded into position beneath the cans, the folded ends of the gusset panel segments 86 and 88 are moved up against the bottoms of the cans. The position of the folded gusset locking panels with respect to the bottom panel and with respect to the cans is further illustrated in FIG. 6. It can be seen that the outer bottom edges of the end cans in the package rest on the folded portions of the gusset locking panels 38. Because the end panel flaps are connected to the gusset locking panels, the fact that the gusset panels 38 are locked in place by the weight of the cans resting on them also locks the end panel flaps in place, enabling them to restrain outward movement of the bottles. In addition, because the side panel locking flaps 40 are pinched between the side panels and the adjacent cans, the upper and lower gusset restraint panels are also locked in place. While the width of the gusset panel segments is a matter of design preference, they must be wide enough to allow a significant area of the folded gusset panel to engage the bottom of a can without interfering with the locking of the bottom panel flaps.

While the various folding steps described can be done by hand it is contemplated that they would be carried out in a packaging machine as the cans and blank are continuously moving through the machine. In that event the locking panel flaps 40 and the gusset panel segments 86 and 88 would be engaged and moved by suitable packaging machine elements in order to fold the locking panel flaps and the locking gusset panels. Neither the packaging machine nor the folding elements of the machine have been shown since the various mechanical movements required in order to fold the panels of a carrier into place are well within the scope of one skilled in the packaging machine art.

Although the details of locking the bottom panel flaps together have not been illustrated since the particular locking mechanism employed does not form part of the invention, it will be understood by those familiar with the locking elements shown that the locking tabs 54 are first folded back about the fold lines 48 and the primary male locking tabs 52 are then engaged beneath the primary female locking edges 58 in bottom panel flap 44. The outer portions of the secondary male locking tabs 54 are then inserted through the slits 60 to complete the mechanical locking action.

Figure 7:
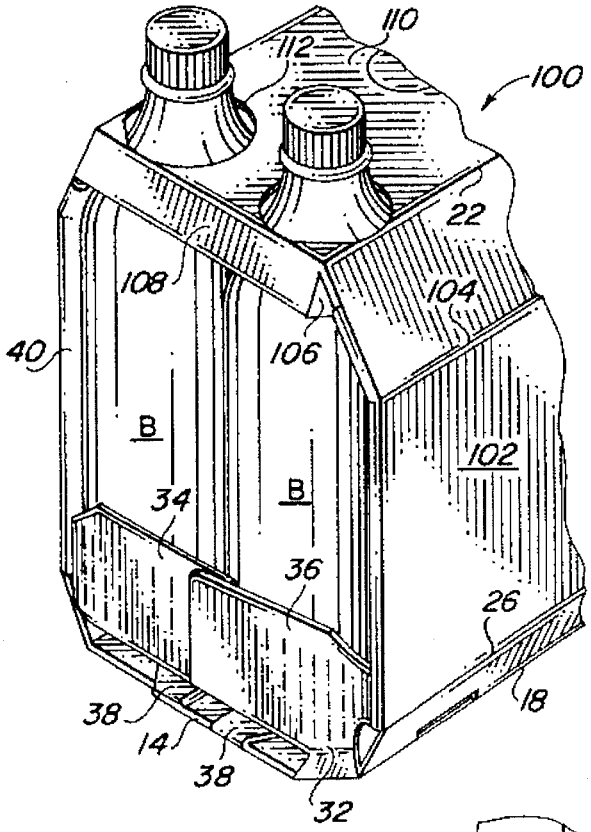
FIG. 7 is a partial pictorial view of a carrier for packaging bottles.

The same principles of construction may be employed in a carrier designed to package bottles instead of cans. Referring to FIG. 7, the lower portion of the carrier 100 is similar to the lower portion of the carrier of FIG. 1, including lower gusset restraints 32, gusset locking panels 38 and side panel locking flaps 40. In this embodiment, however, the side panels 102 include a score line 104 and a sloped upper shoulder portion in order to better accommodate the shape of the bottles. The upper corner gusset restraints 106 are somewhat smaller than the similar restraints in the first embodiment, although their formation is similar. In addition, a short upper end flap 108 is connected to the top panel 110 and to the upper gusset restraints 106. The necks of the bottles B extend up through openings 112 in the top panel.

Figure 8:
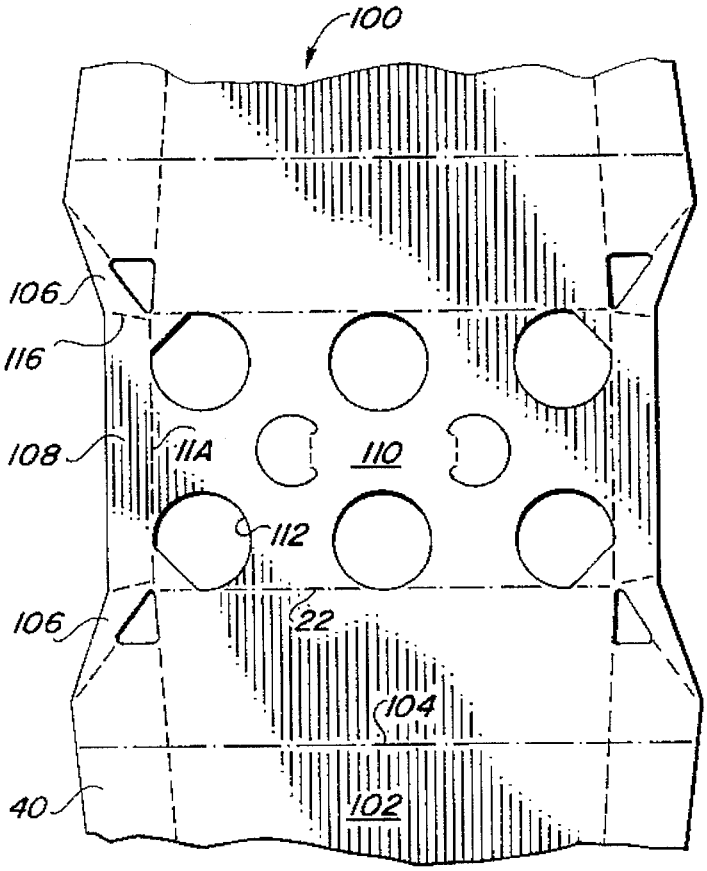
FIG. 8 is a partial plan view of a blank for forming the carrier of FIG. 7.

The details of the central portion of the blank which forms the upper portion of the carrier are shown in FIG. 8, wherein the upper end flap 108 is connected to the top panel section 110 by fold line 114 and to the upper gusset restraint 106 by fold line 116. The manner of forming the carrier is essentially the same as described in connection with the carrier of FIG. 1, although in this case the formation of the upper gusset restraints automatically causes the upper end flap 108 to fold down into position. Also, in this embodiment the score line 104 extends across the locking flaps 40, enabling the locking flaps and the side panel to fold along the score line to form the upper shoulder portion of the side panels.

Although the carrier has been described in connection with the packaging of beverage cans and bottles, it is clear that the invention may be utilized in connection with the packaging of other types of articles as well. It will be appreciated that the articles may instead be inverted and placed into position on the blank prior to folding of the blank instead of placing the blank on top of upright articles as described. It should also be appreciated that the thickness of the blank has been exaggerated in the drawing for the purpose of illustration, and that the material of the blank, preferably paperboard, would actually be substantially thinner.

It should now be apparent that the invention provides a means for covering the pricing code of end articles in a wrap-around carrier by positively locking partial end panel flaps in place closely adjacent to the end articles, and also provides additional restraining structure for assisting to hold the end articles in place. It will be understood, however, that the invention is not limited to all the specific details described in connection with the preferred embodiment and that changes to certain features of the preferred embodiments which do not alter the overall basic function and concept of the invention may be made without departing from the spirit and scope of the invention defined in the appended claims.

What is claimed is:

1. A package comprised of a wrap-around carrier containing two rows of adjacent articles, comprising:

opposite side panels connected to top and bottom panels, the bottom panel being comprised of a first bottom panel flap connected to a second bottom panel flap, each bottom panel flap and each side panel having opposite end edges;

a first end panel flap connected to each of the end edges of the first bottom panel flap and a second end panel flap connected to each of the end edges of the second bottom panel flap;

a lower corner restraint panel connected to each end edge of the first and second bottom panel flaps and contacting adjacent articles in the package, the end panel flaps being connected to the lower corner restraint panels; and first and second means for locking the end panel flaps in place, the first locking means being connected to the bottom panel flaps and the second locking means being connected to the side panels, each of the first and second locking means engaging an adjacent end article in the package.

2. A package as defined in claim 1, wherein the first locking means comprises a gusset panel connected by fold lines to each end panel flap and to the associated bottom panel flap, each gusset panel having an intermediate fold line extending between the adjacent end article and the associated bottom panel flap.

3. A package as defined in claim 2, wherein the second locking means comprises a side panel locking flap connected to each end edge of the side panels along a fold line, each side panel locking flap also being connected to a lower corner restraint panel along a fold line, each side panel locking flap extending between, and being in contact with, the adjacent end article and the associated side panel.

4. A package as defined in claim 3, including an upper corner restraint panel connected by fold line to each side panel locking flap and by fold line to the top panel, the upper corner restraint panels contacting adjacent articles in the package.

5. A package as defined in claim 3, wherein the articles are cans of substantially cylindrical shape.

6. A package as defined in claim 3, wherein the articles are necked bottles having bodies of substantially cylindrical shape.

7. A package as defined in claim 6, wherein the top panel includes openings through which the necks of the bottles extend, the carrier further including an upper partial end panel connected by fold line to each end of the top panel, each upper partial end panel also being connected by fold line to associated upper restraint panels.

8. A package as defined in claim 3, wherein the articles have lower portions of substantially cylindrical shape and the end panel flaps contain substantially vertical score lines which enable the end panel flaps to follow the contour of adjacent articles.

9. A package as defined in claim 2, wherein the end panel flaps are an extension of the associated lower corner restraint panels.

10. A blank for forming a wrap-around carrier for packaging two rows of adjacent articles, comprising:

a sheet including a centrally located top panel section;

opposite side panel sections connected to the top panel section by fold lines;

a bottom panel flap connected to each of the side panel sections by a fold line;

the side panel sections and the bottom panel flaps having opposite end edges;

an end panel flap connected to each of the end edges of the bottom panel flaps;

a lower corner restraint panel connected to each end edge of the bottom panel flaps for contacting adjacent articles in a carrier formed from the blank, the end panel flaps being integral with the lower corner restraint panels; and first and second means for locking the end panel flaps in place in a carrier formed from the blank, the first locking means being connected to the bottom panel flaps and the second locking means being connected to the side panels, each of the first and second locking means engaging an adjacent end article in such a carrier.

11. A blank as defined in claim 10, wherein the first locking means comprises a gusset panel connected by fold lines to each end panel flap and to the associated bottom panel flap, each gusset panel having an intermediate fold line extending between the adjacent end article and the associated bottom panel flap in a carrier formed from the blank.

12. A blank as defined in claim 11, wherein the second locking means comprises a side panel locking flap connected to each end edge of the side panel sections along a fold line, each side panel locking flap also being connected to a lower corner restraint panel along a fold line, each side panel locking flap extending between, and being in contact with, the adjacent end article and the associated side panel in a carrier formed from the blank.

13. A blank as defined in claim 12, including an upper corner restraint panel connected by a fold line to each side panel locking flap and by a fold line to the top panel section, the upper corner restraint panels contacting adjacent articles in a carrier formed from the blank.

* * * * *